US005918706A

United States Patent [19]

Kowalczyk et al.

[11] Patent Number: 5,918,706

[45] Date of Patent: Jul. 6, 1999

[54] HOLD CLOSED FEATURE FOR ELEVATOR CAR DOORS

[75] Inventors: Thomas M. Kowalczyk, Farmington; Richard N. Fargo, Plainville, both of Conn.

[73] Assignee: Otis Elevator Company, Farmington, Conn.

[21] Appl. No.: 08/977,197

[22] Filed: Nov. 24, 1997

[51] Int. Cl.[6] ..... B66B 13/06

[52] U.S. Cl. ..... 187/335; 187/334

[58] Field of Search ..... 187/335, 334, 187/324; 49/409

[56] References Cited

U.S. PATENT DOCUMENTS

| | | | |
|---|---|---|---|
| 4,313,525 | 2/1982 | McDonald | 187/57 |
| 4,423,799 | 1/1984 | Glaser et al. | 187/57 |
| 4,491,200 | 1/1985 | Thompson et al. | 187/61 |
| 4,947,964 | 8/1990 | Husmann | 187/52 |
| 5,165,142 | 11/1992 | Pilsbury | 49/409 |
| 5,246,089 | 9/1993 | Husman et al. | 187/52 |
| 5,386,886 | 2/1995 | Kobayashi et al. | 187/335 |
| 5,461,829 | 10/1995 | Lehto et al. | 49/409 |
| 5,690,189 | 11/1997 | Karner | 187/335 |
| 5,819,877 | 10/1998 | Rivera et al. | 187/335 |

FOREIGN PATENT DOCUMENTS

| | | | |
|---|---|---|---|
| 0332841A1 | 2/1989 | European Pat. Off. . | |
| 0513509A1 | 4/1992 | European Pat. Off. . | |
| 404028690 | 1/1992 | Japan | 187/334 |
| 408697 | 9/1966 | Switzerland . | |
| 2112352 | 7/1983 | United Kingdom . | |

*Primary Examiner*—William E. Terrell
*Assistant Examiner*—Khoi H. Tran

[57] ABSTRACT

An elevator car includes a hold closed feature for an elevator car door. The hold closed feature maintains the elevator car door in a hold closed position when the elevator car is not at a landing or is "parked" at a landing. The hold closed feature includes a profiled ramp disposed on the elevator car and a roller disposed on the elevator car door. The roller engages the profiled ramp during the hold closed position of the elevator car until a certain predetermined force is exerted for the roller to disengage from the profiled ramp.

3 Claims, 3 Drawing Sheets

HOLD CLOSED FEATURE FOR ELEVATOR CAR DOORS

TECHNICAL FIELD

The present invention relates to elevator car doors and, more particularly, to a hold closed feature therefor.

BACKGROUND OF THE INVENTION

Elevator car doors in elevator systems must be closed during movement of the elevator car within the hoistway and while the elevator car is "parked" at a landing. Some elevator codes also require that a certain minimal force be applied to maintain the elevator car doors closed as the elevator car travels within the hoistway. Additionally, for performance reasons, it is desirable to prevent elevator car doors from rattling as a result of vibrations in the hoistway.

Typical elevator car door systems that use conventional rotary motors and mechanical linkages include a counterweight to maintain the elevator car doors closed while the elevator car is moving. Also, conventional rotary motors continue exerting a relatively small electrical force to maintain the elevator car doors closed.

Some modern elevator car doors eliminate mechanical linkages with the counterweight, and instead are driven by a linear motor. Placing a counterweight on elevator car doors driven by a linear motor is impractical for a number of reasons. First, an additional weight contributes to moving mass of the door system which is undesirable. Second, the counterweight requires additional hardware, thereby increasing the cost and reducing reliability. Furthermore, in linear motor driven door systems, the space is limited and the counterweight cannot be accommodated.

Another option for linear motor driven door systems is to maintain the elevator car doors in the closed position by a force generated by the linear motor. However, using a linear motor to maintain the elevator car doors in the hold closed position has a number of disadvantages. One disadvantage is that it may contribute to overheating the motor, thereby reducing the life of the motor. Another disadvantage to utilizing the linear motor to maintain elevator car doors in a hold closed position is the additional consumption of energy. Therefore, it is desirable to have an effective scheme for maintaining elevator car doors in a hold closed position.

In Japanese patent application 4-28690, published Jan. 31, 1992, an elevator door has main rollers settle into recessed portions of their tracks, so the entire door is lowered as it closes. On opening, however, the mass of the entire door must be moved upwardly to disengage the door rollers from the recesses, which consumes significant power, requiring a larger door motor, putting strain on the entire door operating system, and slowing down the door opening process.

DISCLOSURE OF THE INVENTION

It is an object of the present invention to maintain elevator car doors in a hold closed position without contributing to overheating of a linear motor driving the elevator car doors.

It is another object of the present invention to minimize energy consumption of a motor driving the elevator car doors.

It is a further object of the present invention to include a hold close feature without requiring additional hardware for existing door systems.

According to the present invention, a roller disposed on a member vertically moveable on an elevator car door engages a profiled ramp disposed on an elevator car to maintain the elevator car doors in a hold closed position when the elevator car is not at a landing or is "parked" at a landing. The ramp is profiled so that the roller is engaged with the profiled ramp until a certain predetermined force is exerted for the roller to disengage from the profiled ramp and thereby to release the elevator car doors from the hold closed position.

In one embodiment of the present invention, the roller used for engaging the profiled ramp is part of the existing actuator coupler and is disposed on a coupling vane. The profiled ramp is shaped to ensure that a certain predetermined force is required to disengage the roller from the ramp. This configuration utilizes existing hardware and neither adds cost to the existing product nor reduces reliability.

In an alternate embodiment of the present invention, the roller is disposed on an independent member, slidably mounted either on the elevator car door or on the door hanger from which the elevator car door is suspended. The profiled ramp is disposed on the elevator car. This embodiment can be used with any existing door system configuration.

One major advantage of the present invention is that heating of the motor during hold closed operations is reduced. Since the motor does not need to be used during hold closed operations, the life and reliability of the motor are increased.

Another major advantage of the present invention is that it results in cost savings realized from a decrease in energy consumption.

A further advantage of the present invention is that it is adaptable to any door design. An additional advantage of the present invention is that the implementation of the present invention does not require additional hardware.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
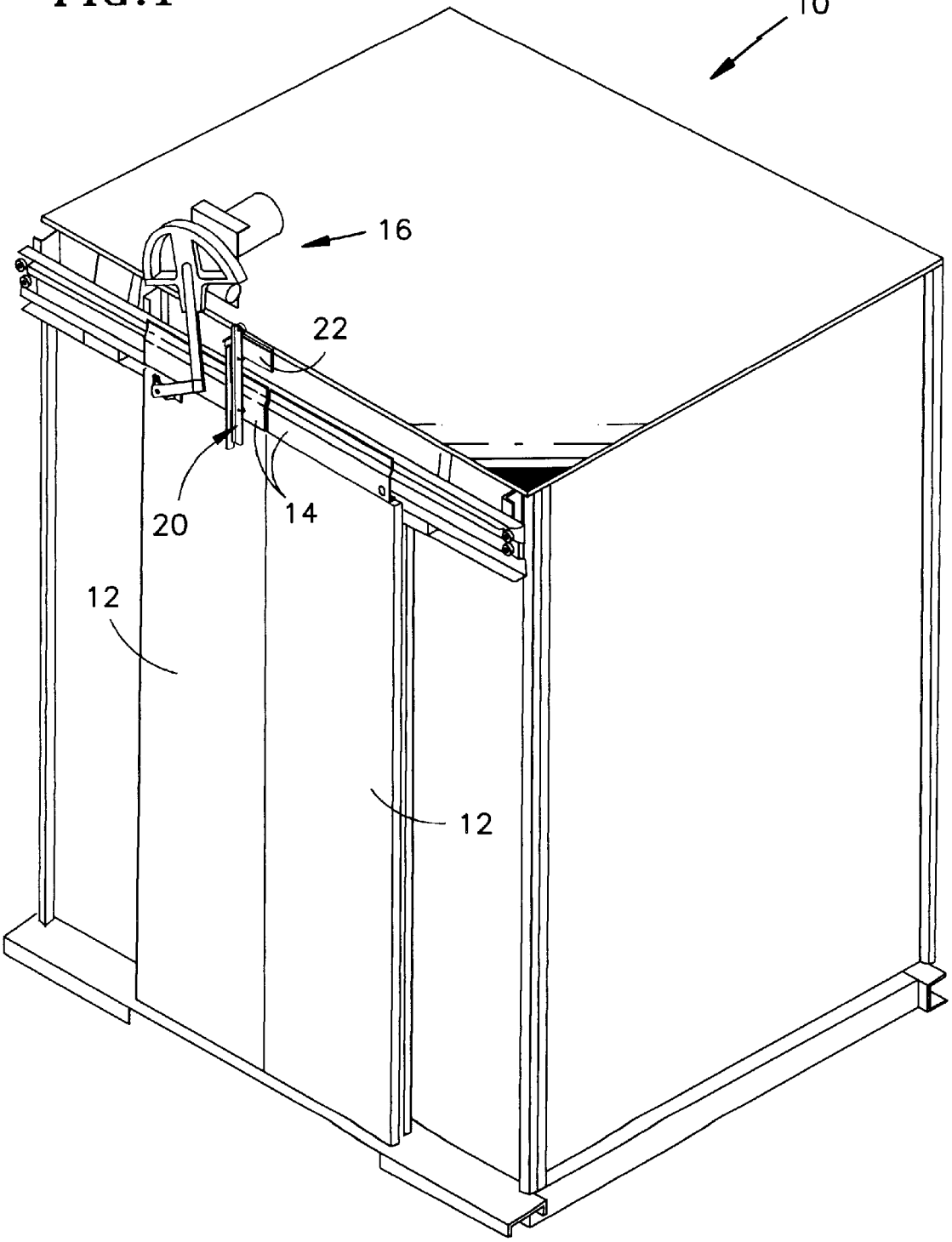
FIG. 1 is a simplified perspective view of an elevator car with a door system driving a pair of elevator car doors.

Referring to FIG. 1, an elevator car 10 traveling within a hoistway (not shown) includes a set of elevator car doors 12 suspended from door hangers 14 and operated by a door actuation system 16. The elevator car 10 also includes an actuator coupler 20 attached to one of the door hangers 14 and a ramp 22 attached to the elevator car 10.

Figure 2:
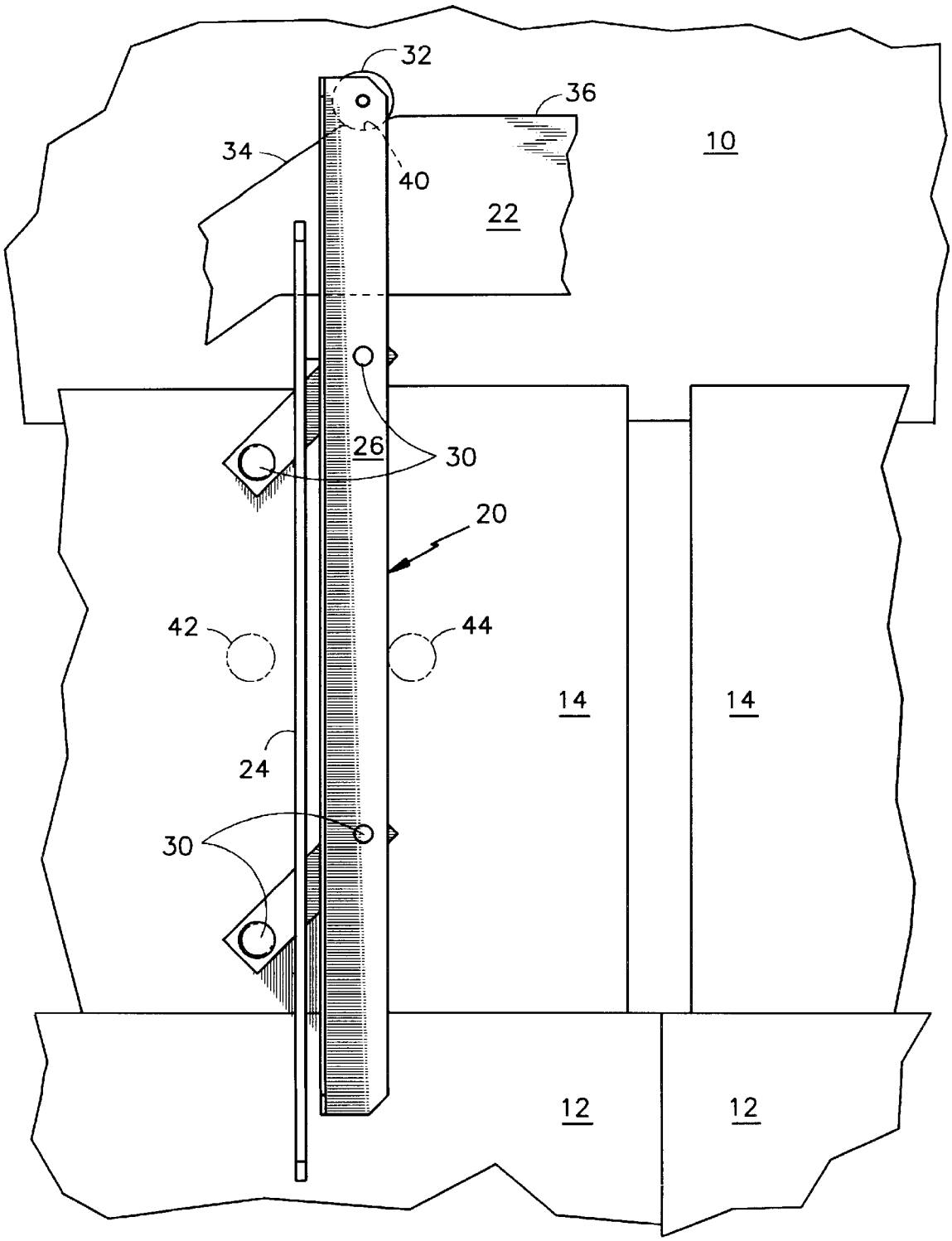
FIG. 2 is an enlarged front view of an actuator coupler of FIG. 1 with a hold closed feature, according to the present invention.

Referring to FIG. 2, the actuator coupler 20 includes a stationary vane 24 fixedly attached to the door hanger 14 and a coupling vane 26 pivotably attached to the door hang 14 by means of pivots 30. The actuator coupler 20 also includes a roller 32 attached to the upper portion of the coupling vane 26. The ramp 22 includes a first profiled surface 34 and a second profiled surface 36. A groove 40 is formed within the second profiled surface 36.

In operation, as the elevator car 10 travels within the hoistway or is "parked" at a landing, the elevator car doors 12 remain closed in a hold closed position. During the hold closed position, the roller 32 of the actuator coupler 20 remains retained within the groove 40 of the second profiled surface 36 of the ramp 22. When the elevator car 10 arrives at a landing with the elevator car doors 12 disposed across a set of hoistway doors (not shown) and the elevator car doors 12 are commanded to open, the coupling vane 26 fits between a first and a second interlock rollers 42, 44 (shown in phantom) of an interlock mechanism (not shown) disposed on the hoistway doors. The door actuation system 16 activates the elevator car doors 12 to open. The hold closed feature of the present invention requires the door actuation system 16 to produce an initial force that exceeds a predetermined threshold value to open the doors. Once the door actuation system 16 exceeds the predetermined threshold value, the roller 32 clears the groove 40 and travels downward along the first profiled surface 34 of the ramp. The roller 32, in conjunction with gravity, causes the coupling vane 26 to rotate downward. The coupling vane 26 and the stationary vane 24 engage the hoistway rollers 42, 44 of the interlock mechanism causing each hoistway door to open with a corresponding elevator car door 12.

When the doors 12 are commanded to close, the door actuation system 16 causes the elevator car doors to close. The roller 32 travels upward on the first profiled surface 34, moving the coupling vane 26 upward to disengage from the hoistway rollers 42, 44 of the interlock mechanism. When the elevator car doors close, the roller 32 engages the groove 40 and remains engaged with the groove 40. The elevator car doors 12 remain closed while the elevator car 10 travels within the hoistway and while it is "parked" at a landing to fulfill the elevator code requirement that the elevator car doors be held closed during those conditions. However, the elevator car doors 12 can be opened from the inside of the elevator car 10 once a certain predetermined force is exerted. Depending on the amount of the predetermined force required by the elevator code, the shape of the groove 40 can be modified. The hold closed force is a function of the angle of the surface 40 the roller 32 is contacting and of the vertical forces acting on the roller 32, such as weight and gravity.

Figure 3:
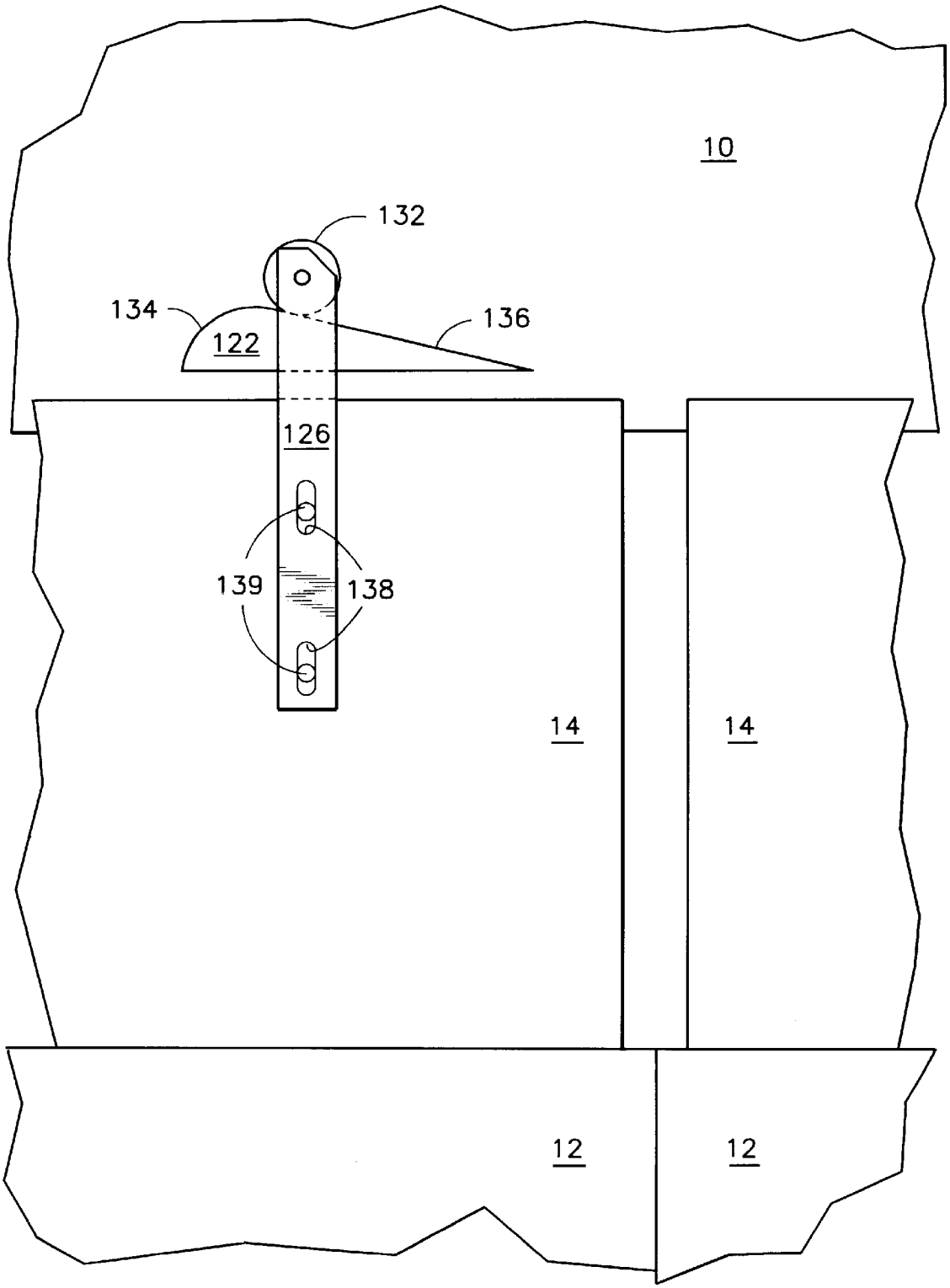
FIG. 3 is an enlarged front view of a door hanger of FIG. 1 with an alternate embodiment of a hold closed feature.

Referring to FIG. 3, an alternate embodiment of the hold closed feature includes a profiled ramp 122 disposed on the elevator car 10 and an arm 126 with a roller 132 protruding upward from the door hanger 14. The arm 126 includes slots 138 moving about pivots. The profiled ramp 132 includes a first profiled surface 134 and a second profiled surface 136. In the hold closed position, shown in FIG. 3, the second profiled surface 136 of the profiled ramp 122 engages the roller 132. As the doors 12 move into the open position in the opposite direction from each other, once the initial predetermined value of the force is applied, the roller 132 is disengaged from the second profiled surface 136 of the ramp 122 as the door 12 continues to open. The slots 138 allow vertical movement of the roller 132.

Thus, the present invention ensures that the elevator car doors 12 are held closed during movement of the elevator car 10 within the hoistway and while the elevator car is parked at a landing, and that a certain force be applied to open the elevator car doors. The present invention also minimizes rattling resulting from vibrations in the hoistway.

The present invention accomplishes these advantages without additional hardware and without having to operate a motor during hold closed positions of the doors. This advantage eliminates a possibility of overheating the motor and reduces the energy consumption.

Another advantage of the present invention is that it can be implemented with any type of door operating system configuration.

While the present invention has been illustrated and described with respect to a particular embodiment thereof, it should be appreciated by those of ordinary skill in the art, that various modifications to this invention may be made without departing from the spirit and scope of the present invention. For example, although FIG. 1 shows a conventional door actuation system 16, the present invention can be used with a linear motor driven door system.

We claim:

1. An elevator system including an elevator car having an elevator car door comprising:

a ramp having a profiled surface, said ramp being attached to said elevator car;

a door hanger for said elevator car door;

a member movably disposed on said door hanger and moveable between a first position and a second position vertically displaced from said first position;

a roller disposed on said member and engaging said profiled surface of said ramp with said member in said first position to hold closed said elevator car door in a door hold closed position, and disengaging from said profiled surface of said ramp with said member in said second position in a door opening position subsequent to application of a certain predetermined force to said elevator car door.

2. The elevator system according to claim 1 wherein said roller being a part of an actuator coupler disposed on said elevator car door.

3. A hold closed mechanism maintaining an elevator car door of an elevator car in a hold closed position, said hold closed mechanism comprising:

a door hanger for said elevator car door;

a coupling ramp being fixedly attached to said elevator car, said coupling ramp having a profiled surface;

a hoistway door coupling vane movably disposed on said door hanger and moveable between a hold closed position and an opening position vertically displaced from said closed position; and a roller disposed on said coupling vane, said roller engaging said profiled surface of said coupling ramp to hold closed said elevator car door with said coupling vane in said hold closed position and disengaging from said profiled surface of said coupling ramp with said coupling vane in said opening position subsequent to application of a certain predetermined force to said elevator car door.

* * * * *